United States Patent [19]

Goodin

[11] Patent Number: 4,951,989

[45] Date of Patent: Aug. 28, 1990

[54] FIRE HYDRANT SETTING TOOL

[76] Inventor: Roy Goodin, Rt. 1, Box 307A, Hartman, Ark. 72840

[21] Appl. No.: 419,587

[22] Filed: Oct. 10, 1989

[51] Int. Cl.[5] ..... B66C 1/62

[52] U.S. Cl. ..... 294/90; 294/67.3

[58] Field of Search ..... 294/28, 31.1, 31.2, 294/67.1, 67.3, 67.32, 68.26, 68.3, 87.22, 87.28, 89–91, 104, 113, 119.2

[56] References Cited

U.S. PATENT DOCUMENTS

| | | | |
|---|---|---|---|
| 1,021,984 | 4/1912 | Holmes | 294/90 |
| 1,314,996 | 9/1919 | Wilson | 294/90 |
| 1,343,548 | 6/1920 | Branin | 294/113 |
| 1,385,435 | 7/1921 | Dunn | 294/91 |
| 1,614,400 | 1/1927 | Selman et al. | 294/68.26 |
| 1,627,291 | 5/1927 | Madsen | 294/90 |
| 2,409,684 | 10/1946 | Jenkins | 294/87.22 |
| 2,820,999 | 1/1958 | Meltzer et al. | 294/67.3 |
| 2,875,982 | 3/1959 | Unglesby | 294/90 X |
| 3,215,464 | 11/1965 | Overman | 294/90 |

*Primary Examiner*—Johnny D. Cherry
*Attorney, Agent, or Firm*—Robert R. Keegan

[57] ABSTRACT

There is disclosed a fire hydrant setting tool useful in engaging the top of a fire hydrant in a manner to maintain it in a vertical position while being lowered and installed for connection to a water main. The tool includes a collar formed of a pair of flat steel plates pivotally connected together to permit relative rotational movement while maintaining the plates in generally coplanar relation, the plates having arcuate openings with one being slightly larger than the other and positioned so that when the plates are closed together an opening in the form of a circle only slightly larger than the cross section of the body of a conventional fire hydrant and smaller than the enlarged cap of such fire hydrant is formed. A bail in the shape of an inverted V formed of steel rod or the like rigidly attaches to the plate having the larger opening so that the apex of the V is directly above the center of the circular opening with the attachment points of the bail being on an extended diameter of the circle. The pivot point for relative motion of the plates is displaced from that diameter by about three inches. The two plates of the collar are maintained in coplanar relation by steel guide plates secured on the faces of one of the collar plates at the bail attachment points and extending past the edge of that plate to engage faces of the other plate. The plates are latched in closed position by a pin passing through two of the guide plates and a collar plate.

7 Claims, 1 Drawing Sheet

FIRE HYDRANT SETTING TOOL

The present invention relates to tools for grasping and manipulating heavy bulky objects such as fire hydrants as is necessary when installing them and connecting them to water mains. The tool according to the present invention is of very robust construction and well able to resist damage from the rough handling which tools in heavy construction may be expected to receive. One size tool will handle the vast majority of fire hydrants currently in use and at most two or three sizes would handle all types of fire hydrants. The attachment of the tool to the fire hydrant is very simple and essentially foolproof and there is virtually no danger of job injuries from inadvertent release of a fire hydrant from the tool. The arrangement of the tool is such that the hydrant is maintained in a vertically plumb manner thereby facilitating alignment of the bottom of the fire hydrant with a water main connection with little physical effort on the part of those installing the hydrant. The bail is readily grasped by a hook from a cable hoist, or frequently by a cable and hook connected to a front end loader or the like.

In use the fire hydrant to be installed or removed is encircled by a heavy steel plate of the tool forming a solid circular collar. The opening in the collar when it is closed and latched is somewhat smaller than the typical flange on the cap of the fire hydrant so that it is virtually impossible for the hydrant to escape from the grasp of the tool until the collar is opened after the hydrant has been installed in position or otherwise placed at a desired location. The tool according to the invention does not incorporate a clamp in the sense that a clamp may be tightened to greater or lesser degrees. Since the tool has a collar which is either locked on the fire hydrant or unlocked, there is little room for human error.

Tools for lifting and installing fire hydrants are known as represented by the disclosure of U.S. Pat. No. 3,215,464 to F.D Overman granted Nov. 2, 1965 (CL. 294-90). The Overman device is a clamping mechanism as opposed to the collar structure of the present invention and comprises a ring portion which is designed to receive the knob or crown at the top of the fire hydrant and which has depending therefrom a plurality of hooks which extend down and hook under the flange of the fire hydrant cap; the hooks are urged inwardly by a flexible member consisting of a chain or cable with a screw tensioning means. A bail of inverted V shape is connected to the ring atop the cap of the fire hydrant. Overman states that the hook members are pivotally connected to the ring member and the effective link of the chain tension member can be varied in order to accommodate a fire hydrant of substantially any diameter. In achieving the adjustability provided by the Overman structure, the possibility of improperly tightening the tension member renders the tool less secure and increases the possibility of accident or injury. Furthermore, if the chain of Overman is weakened through wear or otherwise, the hazard of the chain breaking and causing the fire hydrant to drop out of the grasp of the tool becomes substantial. It is an important feature of the fire hydrant setting tool of the present invention that the heavy steel plates of a quarter inch thickness (or greater thickness if desired) secure the fire hydrant in the grasp of the tool, and structural failure of the tool which would drop the fire hydrant is virtually impossible.

Other forms of fire hydrant lifting tools are known; in some cases such tools rely upon connection to the caps or the water outlets on opposite sides of the hydrant. Such expedients are shown in U.S. Pat. No. 4,736,765 issued to Marc Campbell, Apr. 12, 1988 (U.P.S. Cl. 137/296) and U.S. Pat. No. 4,706,939 to Claude Gagne issued Nov. 17, 1987 (U.S. Cl. 254/332). The Gagne device does not provide the security in handling and manipulating a fire hydrant as does the tool of the present invention and the patent to Campbell does not actually disclose a fire hydrant handling tool but rather a device for securing the valve and caps of a fire hydrant against tampering.

In addition to providing the features and advantages described above it is an object of the present invention to provide a fire hydrant setting tool consisting essentially of rugged steel plates pivotally connected and arranged so that they can be closed to form a collar slightly smaller than the cap flange of a fire hydrant of predetermined size while being larger than the main body of the fire hydrant under the cap flange and a bail securely attached to the collar with a hooking point on the bail arranged directly above the center of gravity of a fire hydrant grasped by the collar.

It is another object of the present invention to provide a fire hydrant setting tool or the like wherein the fire hydrant is grasped in a circular collar just under the cap flange by a collar of rigid steel plates and one of the plates has a cut-out slightly larger than the other thereby facilitating engagement of the collar around the body of the fire hydrant.

It is still another object of the present invention to provide such a fire hydrant setting tool having two rigid steel plates forming a collar with a bail secured on one of said plates and the pivotal connection between said plates being displaced from the line connecting the attachment points of the bail by a substantial distance of an inch or more, thereby facilitating the engagement of the collar on a fire hydrant while at the same time maintaining a relatively compact structure.

It is yet another object of the present invention to provide a fire hydrant setting tool or the like having an articulated collar of rigid steel plates which can be transformed from an open position permitting it to encircle the fire hydrant to a closed position with a substantially circular inner opening in which there are only two articulated steel plates required to form this circular collar.

Other objects and advantages of the present invention will be apparent from consideration of the following description in conjunction with the appended drawings in which.

Figure 1:
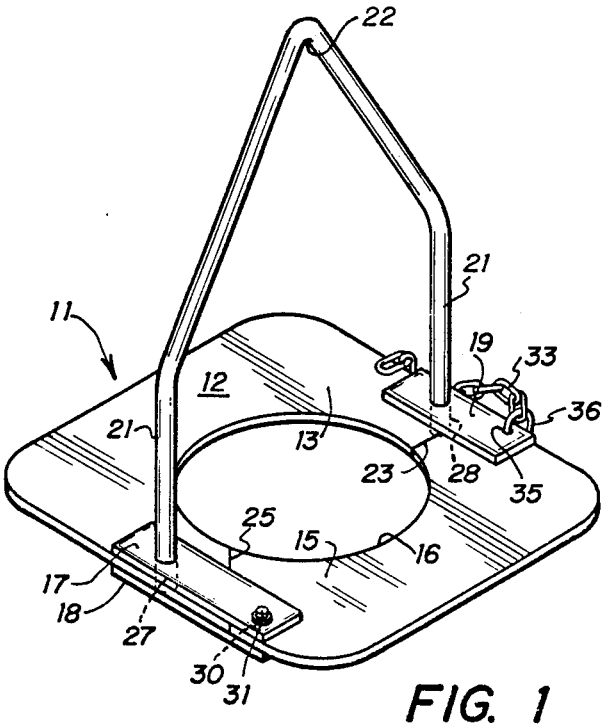
FIG. 1 is a perspective view of a fire hydrant setting tool according to the invention.
Figure 2:
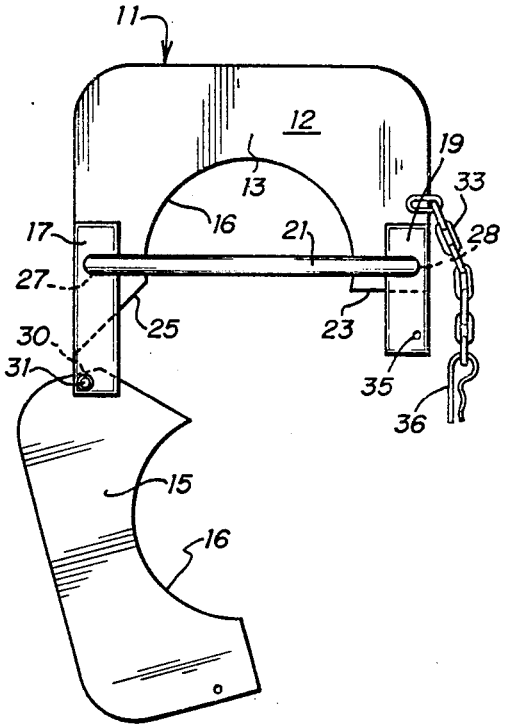
FIG. 2 is a top plan view thereof.

Referring now to the drawings and particularly FIGS. 1 and 2, a fire hydrant setting tool 11 according to the invention includes a generally square rigid collar member 12, preferably formed of steel plate of thickness of one quarter inch or greater, or some equally rugged metal or plastic material. While shown as being square, the outline of the collar member 12 may be circular or some other non-square shape. The collar member 12 is formed of two parts 13 and 15 each of which has an arcuate cutout portion which forms a circular opening 16 when the parts 13 and 15 are closed together, as they would be when lifting or setting a fire hydrant. While the opening formed by the cutouts in parts 13 and 15 could be in the shape of a hexagon, other polygon or other non-circular shape, there appears to be little or no advantage in doing so since virtually all existing fire hydrant bodies are of circular cross section. Plates 13 and 15 may be of aluminum or other metal or reinforced plastic of comparable strength and rigidity to steel.

Figure 3:
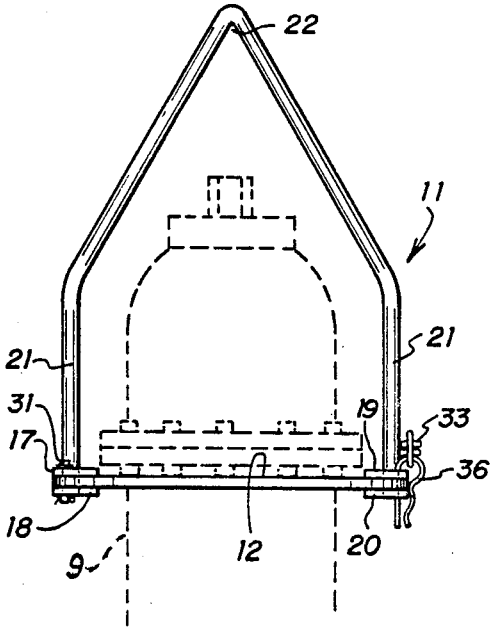
FIG. 3 is a front elevational view thereof.
Figure 4:
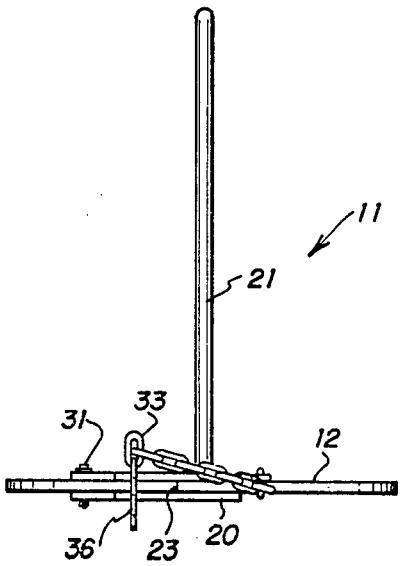
FIG. 4 is a side elevational view thereof.

As best seen in FIGS. 3 and 4, the parts 13 and 15 in the form of plates are arranged to be coplanar and they are very rigidly held in this position by pairs of guide plates 17, 18 and 19, 20.

A bail 21 is secured to collar part 13 preferably by having its ends passed through holes 27 and 28 extending through guide plates 17, 18 and 19, 20 and through collar part 13 and having these parts welded or otherwise fastened together in a permanent and secure manner. In the preferred embodiment the bail 21 is formed of steel rod bent in the shape of an inverted V with the apex of the V located above the center of the circular opening 16 by a distance at least as great as the radius of opening 16 thus to lie along an extension of the longitudinal axis of the cylindrical fire hydrant body. Assuming that the fire hydrant body is generally symmetrical, as is usually the case, the center of gravity of the fire hydrant body will come to rest directly below the apex of the V formed by bail 21 and thus the fire hydrant will naturally tend to assume a vertical position which will greatly facilitate positioning it to be attached to a pipe joint of a water main.

In some cases, particularly when the fire hydrant is to be attached to a large pipe T-joint, it may be desirable to attach the fire hydrant to the T-joint before lowering the fire hydrant into position and this procedure is quite practical with a fire hydrant setting tool according to the invention which will readily lift and support up to several thousand pounds with safety. The fire hydrant or fire hydrant and joint will normally assume a vertical position and are readily rotatable about the vertical axis thereby facilitating the alignment of fire hydrant and pipe necessary to insert bolts or otherwise make the necessary connection of the fire hydrant to the water main.

A hinged connection between parts 13 and 15 in the illustrated embodiment is provided by a hole 30 through the pair of guide plates 17, 18 and through part 15 and a conventional clevis pin 31 which may be a $\frac{3}{8}$ inch diameter, or greater if desired. Hole 30 is displaced by at least one inch from the extended diameter of circle 16 on which ends of bail 21 are secured.

The junction line between parts 13 and 15 may be along a straight line 23 parallel to bail 21 on the one side and on the other side is preferably along a line 25 extending at about a 45° angle to the bail 21 and the diameter of the circle which bail 21 represents. The arc of the cutout portion of part 13 subtends an angle of from 185° to 210° and preferably about 200° and the arc of the cutout in part 15 an arc of about 160°. This is found to substantially facilitate placement of the collar 12 around a fire hydrant, particularly where the pivot axis represented by clevis pin 31 is displaced substantially from the diameter of the circular opening 16. While the distance between the inner end of line 25 and the inner end of line 23 is slightly less than the diameter of the circle due to the unequal division of parts 13 and 15, the difference is very small, on the order of 1 to 2% in the illustrated case. While the collar 12 could be formed in many various ways, the particular arrangement illustrated and described above is believed to be the simplest and most effective configuration. In particular, it compares favorably with articulated collar arrangements in wrenches and similar tools wherein there are three or more articulated parts to facilitate wrapping the parts of the collar completely around a cylindrical or polyhedral body. The safety and security provided by the tool of the present invention is enhanced by the fact that the bail 21 has both ends secured to the same solid steel part 13, thereby eliminating possible failure modes that would exist if there were a greater number of parts of the collar 12.

Any suitable means may be provided for latching the collar 12 in the closed position, the illustrated means being a hair pin cotter 36 which may be engaged in a hole 35 extending through plates 19 and 20 and through part 15; pin 31 and/or pin 36 may be retained by a chain 33 to keep them from being lost when removed. As previously mentioned, it is preferred that the tool be arranged so that it has only one closed position and is not adjustable. Accordingly it will have only one hole 35 for hair pin cotter 36. Then, as in the illustrated embodiment, there is no way to latch the collar 12 in the closed position unless it is entirely closed. This avoids possible accidents with an adjustable collar that, through human error, is improperly adjusted. Either clevis pin 31 or hair pin cotter 36 could be replaced by a bolt or other equivalent fastening means to achieve the same functional operation.

It should also be noted that while it is preferred that bail 21 be rigid and immovably secured to part 13 in most circumstances, bail 21 could optionally be formed of a length of chain secured in eye bolts attached to part 13. Alternatively, bail 21 could itself be rigid but provided with eyes on the ends linked to eye bolts secured in holes 27 and 28.

The operation of the fire hydrant setting tool 11 is believed to be apparent from the previous description but may be more fully explained as follows. Assuming that the preparatory steps of positioning the water main pipe had been accomplished and it remained to lower and affix a fire hydrant to an upwardly opening pipe joint having a mating flange or other connection means, then the collar 12 would be opened, removing hair pin cotter 36 if necessary, and parts 13 and 15 of collar 12 spread apart. Part 15 will pivot through an angle of greater than 90° to create a wide opening through which the body of the fire hydrant 9 can pass into the circular opening 16. Usually this would be accomplished by placing the tool 11 around the fire hydrant 9 rather than placing the fire hydrant in the tool 11.

With the fire hydrant body snugly in the opening in part 13, part 15 is pivoted to the closed position and hair pin cotter 36 is snapped into opening 35, thereby securely locking the hydrant in the tool 11. At this point, bail 21 may be engaged by the hook of a crane or hoist or a hook suspended from a front end loader, lifted and positioned above the hole into which it is to be lowered. The hydraulic powered front end loader or other hoisting mechanism is used to lower the hydrant 9 gently to the desired position with only minor manual adjustment and positioning required. Once the hydrant was secured in place by bolts, or otherwise, hair pin cotter 36 would be removed from hole 35, part 15 swung about clevis pin 31 to open the collar 12, allowing removal of the fire hydrant setting tool 11 from the fire hydrant. As previously mentioned, in some cases it may be desired to assemble the fire hydrant to a T-joint or other water main pipe before lowering it into position, and such procedure is also efficiently carried out by use of the fire hydrant setting tool 11 according to the invention.

In addition to the variations and modifications to the invention which have been described, shown or suggested, other variations and modifications to the invention will be apparent to those skilled in the art and accordingly the scope of the invention is not to be considered as limited to the particular embodiments and variations thereof shown or suggested but is rather to be determined by reference to the appended claims.

What is claimed is:

1. A tool for grasping, lifting or lowering a fire hydrant or the like having a generally cylindrical body with an enlarged end, said tool comprising a collar member formed of a first rigid generally planar plate member, a second generally planar plate member, means for connecting said second plate member to said first plate member in a coplanar relation with freedom of pivotal motion therebetween about a pivotal axis perpendicular to the plane of said plate members and passing through said second plate member, each said plate member having an arcuate opening such that said plate members may be arranged in a position with said arcuate openings forming an opening in the form of a circle, latch means for retaining said plate members in such position, at least one rigid guide plate secured on one of said plate members and overlying the other of said plate members to resist forces tending to bend said plate members out of coplanar relation, and bail means with ends secured at two points on said first plate member located substantially on an extended diameter of said circle, said bail means reaching to a point above the center of said circle by a distance at least as great as the radius of said circle, said bail means being formed of a rigid rod which is secured in an opening passing through both said first plate member and said at least one rigid guide plate.

2. A tool as recited in claim 1 wherein the arcuate opening of said second plate member subtends an angle of less than 180°.

3. A tool as recited in claim 1 wherein there is at least one of said rigid guide plates on each of the opposite surfaces of said one of said plate members.

4. A tool as recited in claim 1 wherein said bail means is formed of a rigid rod generally in the shape of an inverted V.

5. A tool as recited in claim 4 wherein said bail means is rigidly secured with respect to said first plate member and is generally perpendicular thereto.

6. A tool as recited in claim 1 wherein said pivotal axis is displaced from said extended diameter of said circle on which ends of said bail means are secured by at least one inch.

7. A tool as recited in claim 1 wherein said latch means comprises a pin that passes through two of said rigid guide plates and one of said plate members in a substantially perpendicular manner.

* * * * *